US006364721B2

(12) United States Patent
Stewart, III

(10) Patent No.: US 6,364,721 B2
(45) Date of Patent: Apr. 2, 2002

(54) WIRE CONNECTOR

(76) Inventor: Kenneth G. Stewart, III, P.O. Box 1117, Sarasota, FL (US) 34230

( * ) Notice: Subject to any disclaimer, the term of this patent is extended or adjusted under 35 U.S.C. 154(b) by 0 days.

(21) Appl. No.: 09/747,951

(22) Filed: Dec. 27, 2000

Related U.S. Application Data

(60) Provisional application No. 60/171,661, filed on Dec. 27, 1999.

(51) Int. Cl.[7] ..... H01R 11/04

(52) U.S. Cl. ..... 439/784; 439/628; 174/187; 174/87

(58) Field of Search ..... 439/784, 369, 439/347, 348, 628, 433, 527, 535; 174/187, 87, 84 R

(56) References Cited

U.S. PATENT DOCUMENTS

| | | | | | |
|---|---|---|---|---|---|
| 2,009,090 | A | * | 7/1935 | Little | 439/784 |
| 2,009,318 | A | * | 7/1935 | Highfield | 439/784 |
| 5,618,200 | A | * | 4/1997 | Norgaard | 439/427 |
| 5,683,273 | A | * | 11/1997 | Garver et al. | 439/784 |

* cited by examiner

*Primary Examiner*—Gary Paumen
*Assistant Examiner*—James R. Harvey

(57) ABSTRACT

An electrical connector for joining a series of wires, relies on connecting two wire nut assemblies together, by electrically connecting the wires in the nuts with a pin and connecting the wire nuts together to keep the pin in contact with the wires.

17 Claims, 4 Drawing Sheets

WIRE CONNECTOR

Applicant claims priority benefit from provisional application 60/171,661 filed Dec. 27, 1999.

BACKGROUND AND SUMMARY OF THE INVENTION

The present invention relates to a system for connecting a plurality of electrical wires in a quick and efficient manner. Particularly, the present invention relates to a system based on the proven method for electrical wiring, the wire-nut, while significantly expanding its functionality as a connector.

BRIEF DESCRIPTION OF THE DRAWINGS

The detailed description refers to the accompanying figures in which.

DETAILED DESCRIPTION OF THE DRAWINGS

Figure 1:
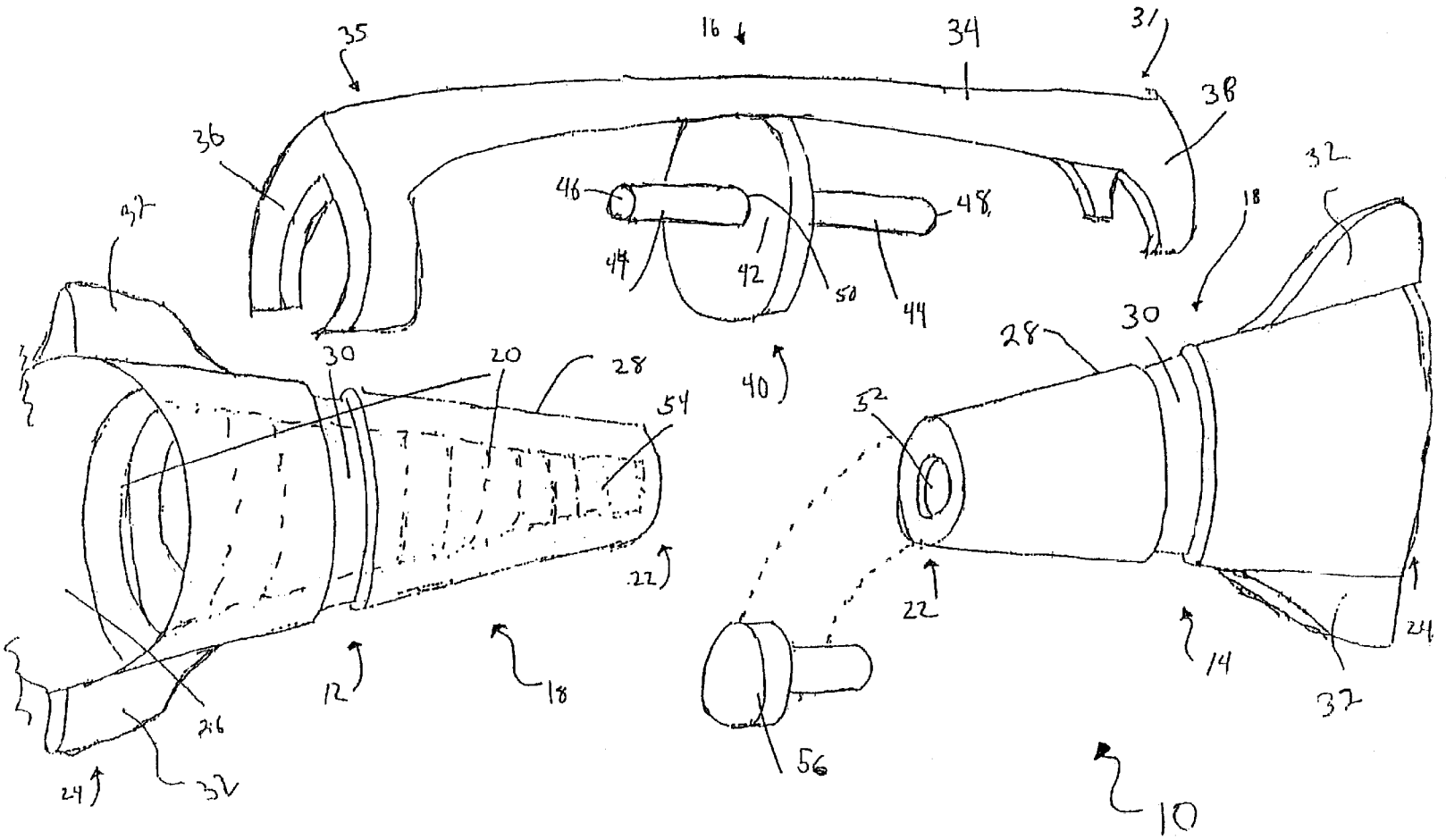
FIG. 1 is a perspective view of the preferred embodiment of the Wire Connector showing two modified wire-nuts, a coupling bracket with an electrical connector to connect the two wire-nuts, and a cap to protect the user from accidental electrocution when applying the individual wire-nuts.

As shown in FIG. 1, a Wire-Nut Connecting System 10 for connecting electrical wires includes a first wire-nut 12 and a second wire-nut 14 identical to the first 12 and a coupling bracket 16. Each wire-nut 12, 14 is separable from the system 10 and independently performs the traditionally known functions of a wire-nut. To facilitate these functions wire-nuts 12, 14 include a hollow conical body 18 with a narrow end 22, a wide end 24 with an aperture 26 sized to receive a plurality of wires, an exterior 28, a circumferential groove 30 embedded in exterior 28 spaced between narrow end 22 and wide end 24, and a pair of wing tabs 32 attached to wide end 34 of body 18 configured to allow a user to exert axial twisting force on the wire-nut 12, 14 and electrical wires. Body 18 further includes a threaded metal interior 20 configured to engage electrical wires inserted into the wire nut 12, 14 via aperture 26.

Coupling bracket 16 includes a body 34 with a first end 35, a second end 37 spaced apart from first end 35, a first clip 36 attached to first end 35 and a second clip 38 attached to second end 37. First and second clips 36, 38 are configured to engage circumferential groove 30 to couple bracket 16 to two wire-nuts 12, 14.

Bracket 16 further includes an electrical coupler assembly 40 coupled to body 34 spaced between first and second ends 35, 37. Assembly 40 includes an insulative disk 42 and an electrically conductive pin 44 with a first end 46 and a second end 48 coupled to disk 42 aligned such that the major axis of pin 44 aligns with the major axis of bracket body 34. Disk 42 includes an aperture 50 sized to receive conductive pin 44 such that disk 42 is positioned to engage pin 44 between first and second ends 46, 48 of pin 44. Narrow end 22 of wire-nut body 18 includes an aperture 52 sized to receive first or second end 46, 48 of pin 44. Threaded metal interior 20 includes a conductive coupling tube 54 configured to conductively engage first or second end 46, 48 of pin 44. Wire-nut body 18 further includes a removable cap 56 configured to engage aperture 50 at the narrow end 22 of body 18 when wire-nut 12, 14 is not coupled to bracket 16. The purpose of cap 56 is to block aperture 52 and protect against unwanted electrical conduction.

During use, one or more wires are prepared for electrical connection by stripping off any insulation near its end thus baring the metal. Wire-nut 12, 14 is applied next by inserting the bared ends of the wires into aperture 26 until in physical contact with the threaded metal interior 20. The user then applies axial twisting force to wing tabs 32 to allow threaded interior 20 to grip the bare wire ends thus electrically connecting all the wires within one wire-nut 12, 14. The same procedure is performed for the other wire-nut 12, 14, yielding two interconnecting pluralities of wire. To utilize the additional aspects of this invention, cap 56 must be removed from narrow end 22 of both wire-nuts 12, 14. Each narrow end 22 is then brought to engage coupler assembly pin 44 at opposite ends 46, 48. Pin ends 46, 48 are thus received by coupling tube 52 attached to threaded metal interior 20 thus providing an electrical connection between the two pluralities of wires, though conductive coupling tube 54 while wire-nut narrow end 22 abuts coupler disk 42 to guard against accidental connection to a potentially exposed pin 44. The final step is to orient wire-nut grooves 30 to engage bracket clips 36, 38 thus preventing accidental separation of pin 44 from wire-nuts 12, 14.

While coupler assembly 40 is shown attached to bracket 16, it could be a stand alone item which is inserted into wire-nuts 12, 14 prior to bracket 16 being snapped on.

Figure 2:
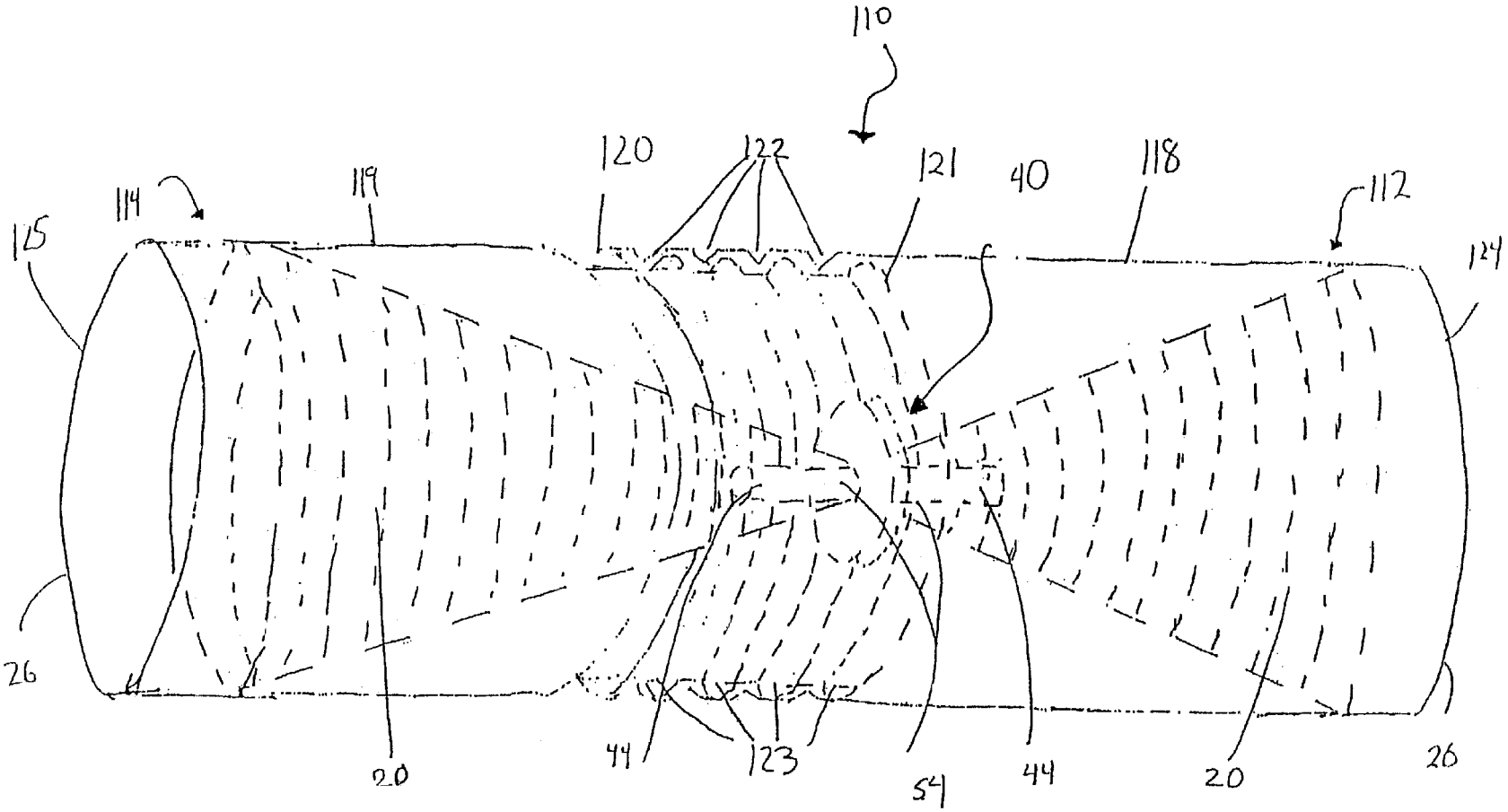
FIG. 2 is a perspective view of a second embodiment of the Wire Connector showing a uni-body configuration with two rotatable segments to independently connect to the wires.
Figure 3:
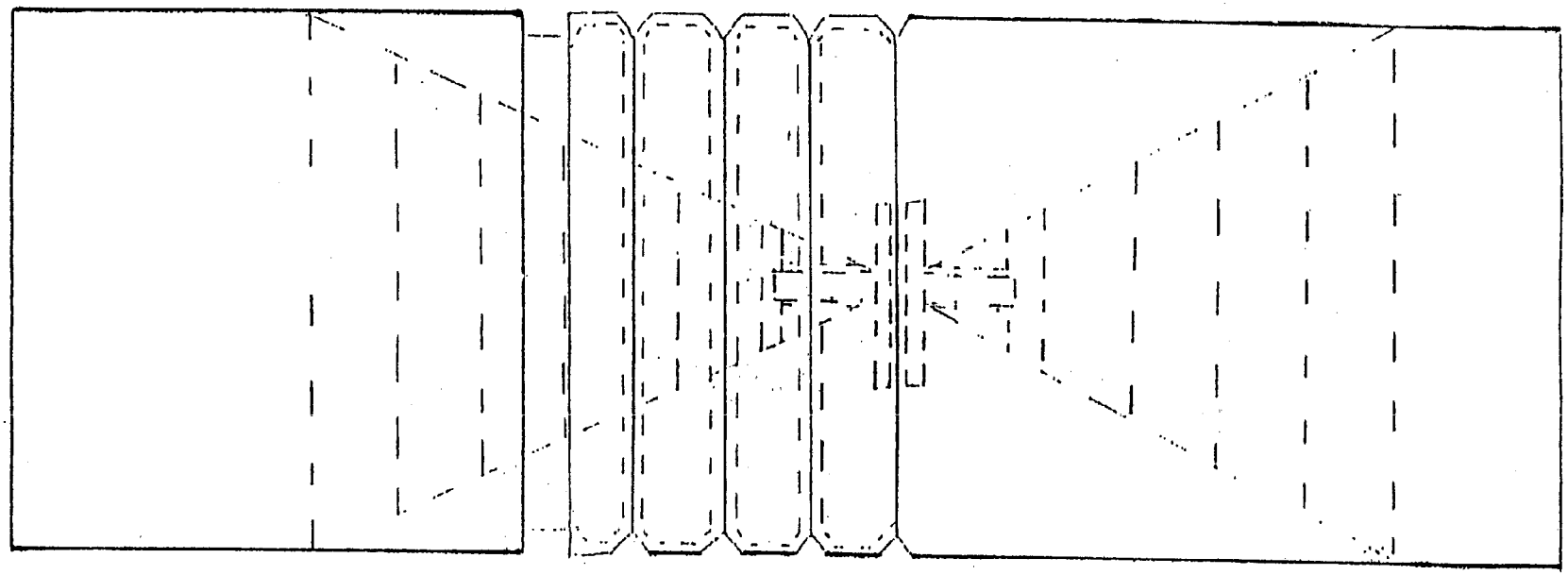
FIG. 3 is a front elevation view of a modification of the embodiment in FIG. 2.

As shown in FIGS. 2 and 3, a first alternate embodiment of the Wire-Nut Connecting System 110 includes many internal components of the primary embodiment 10, here like numbered, in a modified body 111. Body 111 consists of a first connector 112 and a second connector 114 permanently connected in rotatable fashion to the first 112. First connector 112 includes a hollow cylindrical tube housing 118 with a connecting end 120, and circumferential grooves 122 embedded in end 120. Second connector 114 includes a hollow cylindrical tube housing 119 with a connecting end 121 and circumferential ridges 123 attached to end 121 configured to engage grooves 122 in axially rotatable fashion.

Each connector 112, 114 further includes aperture 26 in a second end 124, 125, threaded metal interior 20, and conductive tube 54, each similarly related as in the primary embodiment. Body 111 is configured to house the electrical coupler assembly 40 between the two connecting ends 120, 121 thus coupling the two threaded metal interiors 20 via their respective conductive tubes 54 and conductive pin 44.

Circular grooves 122 and ridges 123 cooperate to permanently couple first and second connectors 112, 114 as the connector 182 is snapped over connector 14 as they are pushed together while allowing them to rotate relative to each other, thus allowing each connector 112, 114 to couple a plurality of wires by axial twisting of the threaded metal interiors 20.

The connectors 112 and 114 could also be provided with wing tabs 32 similar to the embodiment of FIG. 1. While the grooves and ridges are shown as circular, they could be helical to allow one connector 112 to screw onto another connector 114.

Figure 4:
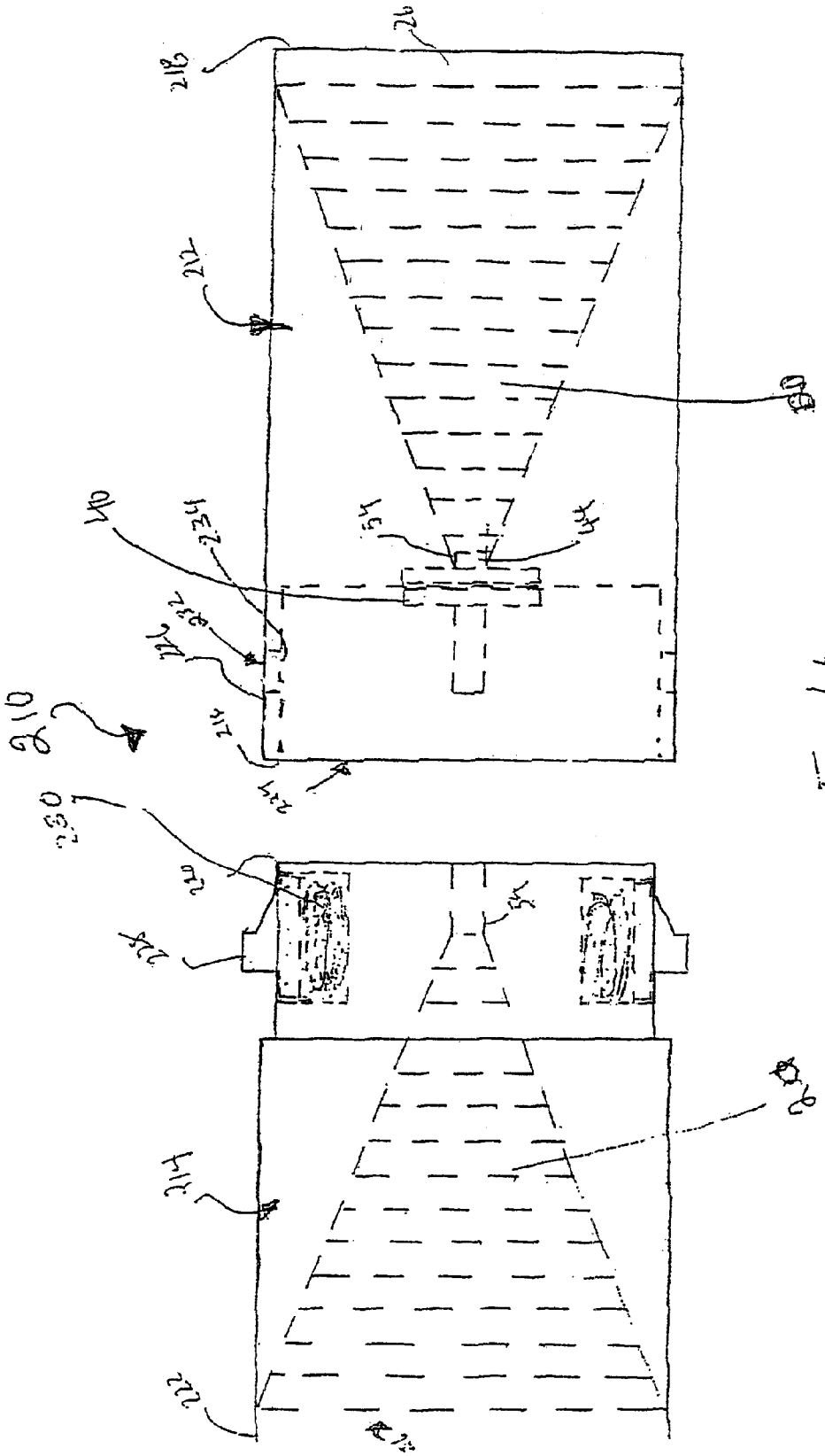
FIG. 4 is a front elevation view of a third embodiment of the Wire Connector showing two separate segments to independently connect wires, with the capacity to couple together via housing interactions.

FIG. 4 illustrates another alternate embodiment of the Wire-Nut Connecting System 210. This embodiment includes many of the components of the primary embodiment 10 and are like numbered in this description. This embodiment further includes a first connector 212 and a second connector 214. First connector 212 has a first end 216 and a second end 218 configured to include aperture 26. Second connector 214 has a first end 220 and a second end 222 configured to include aperture 26. Each connector 212, 214 includes a conical threaded metal interior 20 with conductive tube 54 attached thereto. First conductor 212 further includes electrical coupler assembly 40 attached by pin 44 to conductive tube 54. First end 216 of first coupler 212 includes an aperture 224 sized to receive first end 220 of second coupler 214. Electrical coupler assembly 40 is positioned within aperture 224. First end 216 of first coupler 212 further includes a snap lock 226 configured to engage the tab 226 on first end 220 of second coupler 212 at aperture 224 thus locking the two connectors 212, 214 together. Tab 228 is spring biased outwardly by spring 230 so as to be able to be pushed inwardly to allow the end 216 of coupler 212 to pass over tab 228 which springs outwardly when tab 228 comes into alignment with slot 232 to hold the two couplers together. After coupling, release is obtained by pushing tab 228 inwardly past the bottom surface 234 of slot 232 and pulling connector 212 to the right.

Threaded metal interior 20 and conductive tube 54 are positioned within second connector 214 to engage coupler assembly 40 when second connector snap locks 226 engage aperture 224 of first connector 214. Once coupled, connectors 212, 214 are restricted from moving relative to each other by snap lock 226.

What is claimed is:

1. An electrical connector unit for joining electrical wires comprising:

two body members, the body members each being provided with a conically shaped internal passageway for reception of at least one electrical wires, the conically shaped internal passageway having screw threads on its conical shaped passageway for directly electrically engaging and securing the at least one wire that is received in the passageway, an electrical connector positioned to extend into each passageway of the two body member to provide an electrical connection between wires inserted in the two bodies, securement means to hold the two bodies together.

2. The connector of claim 1 wherein at least one body has an outer recess into which the securement means extends.

3. The connector of claim 1 wherein the securement means is a bracket coupled to each body.

4. The connector of claim 2 wherein the securement means is a bracket coupled to each body.

5. The connector of claim 3 wherein the bracket has depending clips for connection to each body.

6. The connector of claim 4 wherein the bracket has depending clips for connection to each body.

7. The connector of claim 1 wherein the securement means constitute cooperating securement surfaces on each body.

8. The connector of claim 7 wherein the surfaces include a hollow outer recess in one body that contacts an outer surface on another body.

9. The connector of claim 7 wherein the cooperating surfaces include ridges on one body that contact grooves an another body.

10. The connector of claim 8 wherein the cooperating surfaces include ridges on one body that contact grooves an another body.

11. The connector of claim 1 wherein the securement means includes a spring detent holding the two bodies together.

12. The connector of claim 2 wherein the securement means includes a spring detent holding the two bodies together.

13. The connector of claim 7 wherein the securement means includes a spring detent holding the two bodies together.

14. The connector of claim 8 wherein the securement means includes a spring detent holding the two bodies together.

15. The connector of claim 9 wherein the securement means includes a spring detent holding the two bodies together.

16. The connector of claim 2 wherein the other body has a lip that extends over and contacts the outer recess.

17. The connector of claim 8 wherein another body has a lip that extends over and contacts the outer recess.

* * * * *